US010676995B2

(12) United States Patent
Rohart et al.

(10) Patent No.: US 10,676,995 B2
(45) Date of Patent: Jun. 9, 2020

(54) DRILL STEM ELEMENT WITH FLUID ACTIVATION ZONE

(71) Applicant: TUBOSCOPE VETCO (FRANCE) SAS, Berlaimont (FR)

(72) Inventors: Christophe Rohart, Aulnoye-Aymeries (FR); Thomas Didry, Aulnoye-Aymeries (FR)

(73) Assignee: Tuboscope Vetco (France) SAS (FR)

( * ) Notice: Subject to any disclaimer, the term of this patent is extended or adjusted under 35 U.S.C. 154(b) by 20 days.

(21) Appl. No.: 14/234,542

(22) PCT Filed: Jun. 12, 2013

(86) PCT No.: PCT/FR2013/051366
§ 371 (c)(1),
(2) Date: Aug. 19, 2015

(87) PCT Pub. No.: WO2013/190219
PCT Pub. Date: Dec. 27, 2013

(65) Prior Publication Data

US 2015/0361729 A1 Dec. 17, 2015

Related U.S. Application Data

(60) Provisional application No. 61/709,271, filed on Oct. 3, 2012.

(30) Foreign Application Priority Data

Jun. 22, 2012 (FR) ..... 12 55967

(51) Int. Cl.
*E21B 17/00* (2006.01)
*E21B 17/22* (2006.01)
(Continued)

(52) U.S. Cl.
CPC ..... *E21B 17/006* (2013.01); *E21B 17/042* (2013.01); *E21B 17/10* (2013.01);
(Continued)

(58) Field of Classification Search
CPC ..... E21B 17/22; E21B 17/00; E21B 17/1078; E21B 17/042
See application file for complete search history.

(56) References Cited

U.S. PATENT DOCUMENTS 2,959,193 A * 11/1960 Guldenzoph ..... E21B 17/00 138/172
6,056,073 A 5/2000 Boulet
(Continued)

FOREIGN PATENT DOCUMENTS

FR 2 824 104 10/2002
FR 2 851 608 8/2004
(Continued)

OTHER PUBLICATIONS

International Search Report dated Jul. 25, 2013 in PCT/FR13/051366 Filed Jun. 12, 2013.

*Primary Examiner* — David J Bagnell
*Assistant Examiner* — Manuel C Portocarrero
(74) *Attorney, Agent, or Firm* — Conley Rose, P.C.

(57) ABSTRACT

A tubular element for a drill stem includes a substantially cylindrical body and two tool joints. Each tool joint is disposed at one end of the body and provided with a threaded portion that can be joined to a complementary element. At least one of the tool joints has a lifting surface that can cooperate with a lifting tool of the element to connect it into a drill stem. The lifting surface has a non-circular cross-section forming an activation zone for a drilling fluid.

18 Claims, 6 Drawing Sheets

(51) Int. Cl.
*E21B 17/10* (2006.01)
*E21B 17/042* (2006.01)
*E21B 37/00* (2006.01)

(52) U.S. Cl.
CPC ..... *E21B 17/1078* (2013.01); *E21B 17/22* (2013.01); *E21B 37/00* (2013.01)

(56) References Cited

U.S. PATENT DOCUMENTS

| | | | |
|---|---|---|---|
| 6,349,779 | B1 | 2/2002 | Boulet |
| 2003/0221872 | A1 | 12/2003 | Boulet |
| 2004/0195009 | A1 | 10/2004 | Boulet |
| 2010/0326738 | A1 | 12/2010 | Boulet |

FOREIGN PATENT DOCUMENTS

| | | | |
|---|---|---|---|
| FR | 2 927 937 | | 8/2009 |
| SU | 1631158 | A1 | 2/1991 |

* cited by examiner

DRILL STEM ELEMENT WITH FLUID ACTIVATION ZONE

BACKGROUND

The invention relates to the field of exploration and operation of oil or gas fields in which rotary drill stems are used. A drill stem may comprise pipes, heavy weight drill pipes, drill collars, stabilizers or couplings. The pipes are assembled end to end by makeup into a pipe string which constitutes a substantial or even dominant portion of the length of the drill stem. More particularly, the invention relates to a profiled part for rotary drilling equipment such as a pipe disposed in a rotary drill pipe string.

The characteristics of a drill stem, and more generally an element of a drill stem, contribute to the fundamental properties of quality, performance and safety of the general drilling process both during the excavation phases proper and also during phases involving maneuvers between the bottom and the surface.

Advances in hydrocarbon exploration demand making trajectory profiles which are becoming more and more complex under geological conditions which are becoming more and more extreme. Currently, exploration for hydrocarbons is being carried out at depths which are routinely over 4 km with departures with respect to the fixed facility which may exceed ten kilometers. The invention envisages a drill stem element that is in particular adapted for deviated wells, i.e. wells wherein the inclination to the vertical or the horizontal direction can be varied during drilling. Deviated wells can currently reach depths of the order of 2 to 8 km and horizontal distances of the order of 2 to 15 km.

In the case of deviated wells comprising practically horizontal sections, the frictional torques due to rotation of the pipe strings in the well may reach very high values during drilling. The frictional torques may compromise the equipment used or the drilling targets. Further, pulling out the spoil produced by drilling is very often difficult because of sedimentation of the debris produced in the drilled hole, in particular in the portion of the drilled hole that is steeply inclined with respect to the vertical. This results in poor cleaning of the hole and an increase in both the coefficients of friction of the pipes of the pipe string inside the drilled well and the contact surfaces between the pipes and the well walls.

Document FR 2 824 104 discloses a profiled element for rotary drilling equipment comprising a zone for bearing on the wall of the drilled hole, a turbulence zone in order to activate the movement of the drilling fluid in the drilled hole around the drilling equipment, and a deflection zone adjacent to the bearing zone and to the turbulence zone extending in the axial direction of the profiled element and comprising at least one surface which is inclined with respect to the drilling axis, the meridian line of which in an axial plane moves away from the axis of the profiled element in the direction moving from bottom to top in the service position of the profiled element in the drilled hole.

Further, document WO-2009-115687 discloses a drill stem element comprising at least one zone for bearing on the wall of the drilled hole, the bearing zone being provided with at least one bearing section with an external diameter which is greater than the diameter of the other portions of the element, and two activation zones substantially adjacent to the bearing zone and disposed upstream and downstream of said bearing zone.

That type of device has proven satisfactory until recently. However, a need has arisen for lighter weight as well as lower rigidity drill stems while maintaining or even improving pull-out, with the drilling fluid, of debris generated by formation of the hole. In particular, there is a need whereby any improvement in existing drill stems must maintain the pressure drops observed in the drilling fluid below acceptable thresholds in order to avoid clogging by debris becoming caked between the drilled hole and the stem. There is also a need for reducing the manufacturing costs of such drill stems and in particular of simplifying manufacture. Finally, there is a need to homogenize the speed of the drilling fluid right along the stem in order to prevent the hole from blocking up as much as possible.

BRIEF SUMMARY

The invention will improve the situation by proposing a tubular element for a drill stem comprising a substantially cylindrical body and two tool joints, each tool joint being disposed at one end of the body and provided with a threaded portion for joining to a complementary element, at least one of the tool joints having a lifting surface which can cooperate with a lifting tool of the element to connect it into a drill stem, characterized in that the lifting surface has a non-circular cross-section forming an activation zone for a drilling fluid.

A lifting surface of the invention may comprise at least one surface portion extending radially relative to the external circumference of the cylindrical body. The orientation of the lifting surface may be such that it can be used to suspend the element such that the longitudinal axis of the element is substantially vertical. The lifting surface may be engaged in a lifting tool such that the weight of the element holds the lifting surface in the lifting tool.

When used in a drill stem, an element of the invention can reduce the static and dynamic loads in rotation, reduce the axial loads when raising and dropping the well string, increase the capacity for transmitting weight to a drilling tool, improve the drilling spoil lifting capacity, improve the safety margin for over-tension and over-torsion, reduce the critical buckling conditions, reduce wear and abrasion of the drill stem, improve the operating capacity in spoil while being lifted, thereby reducing the risk of blockages, reduce hydraulic pressure drops, improve the flow of mud and spoil around the drill pipe, reduce wear by abrasion of the inner wall of the drilled well, greatly reduce the risk of sticking due to a pressure differential, especially when the hydrostatic pressure of the mud is higher than the pressure existing in the material, for example rock, during drilling, greatly reduce the risks of jamming the pipe string during a pull-out operation and improve the surface quality of the walls of the drilled hole.

In particular, each of the two tool joints may comprise a lifting surface, wherein a cross-section of each lifting surface is non-circular in order to respectively form an activation zone for a drilling fluid therein. Thus, when such elements are assembled one with the other, the junction between two tool joints is systematically bordered on either side by activation zones. Each junction so provided thus promotes homogeneity of the flow along the stem. A drill stem of the invention comprises, between the bottom hole elements and the surface, preferably a large proportion, for example at least 80%, or even more than 95% of elements of the invention as defined hereinabove. In particular, the stem comprises at least one, preferably several successions of three elements in accordance with the invention.

Advantageously, the non-circular cross-section may comprise at least one of a concavity or a flat surface. The non-circular cross-section may thus have at least one edge or leading edge to scrape the piles of debris and take them up again into suspension in the drilling fluid.

In particular, the lifting surface may have a tapered envelope surface provided with at least one concavity. The tapered envelope surface may form an angle in the range 10° to 100, preferably in the range 18° to 90° with the longitudinal axis of the cylindrical body. The concavity may be used to define a supplemental volume that promotes the flow of drilling fluid.

As an example, the concavity of a tool joint may form a groove extending beyond the lifting surface in the direction of the free end of said tool joint. Thus, the volume can be increased, promoting the flow of drilling fluid.

Advantageously, the lifting surface may comprise several distinct concavities in a circumferential direction. Thus, the lifting surface may have several edges or leading edges to scrape the piles of debris. This configuration can further increase the volume, promoting the flow of drilling fluid and thus cleaning of the hole which is being formed. As an example, the lifting surface may comprise 2 to 8, preferably 4 concavities.

Advantageously, these distinct concavities may be disposed in the same section determined perpendicular to the longitudinal axis of the tool joint. In particular, the activation zone of a tool joint may be disposed in a single annular section of said tool joint.

Advantageously, the activation zone may have a generally helical shape about the axis of said element, such that the inclination of the helical shape relative to said axis is preferably in the range 0° to 60°, more preferably in the range 10° to 30°. Thus, the vortex dynamic of the fluid is improved, as well as recirculation of the scooped-up debris.

An element of the invention may comprise a bearing zone for coming into contact with the wall of the hole, such that the activation zone is disposed between the bearing zone and the cylindrical body. Thus, modification of the well wall by the activation zone is avoided.

Advantageously, the lifting surface may be connected to the bearing zone via a first cylindrical portion, the bearing zone being connected to a second cylindrical portion in the direction of the free end of the tool joint. The bearing surface can thus protect the second cylindrical portion where the connection with an adjacent element is formed. It is also possible to increase the service life of the connection between adjacent elements.

In the case in which the activation zone extends beyond the lifting surface in the direction of the free end of said tool joint, it may in particular extend from the lifting surface to the first cylindrical portion.

As an example, at least one of the bearing zone and the first cylindrical portion may comprise a hardened surface, for example by attaching a material with a greater hardness than that of the tool joint or by hardening the surface of said tool joint by heat and/or mechanical treatment.

More particularly, the tool joints may be friction welded to the axial ends of the cylindrical body, such that the concavity is defined at a non-zero distance from the junction between the tool joint and the cylindrical body.

In particular, the dimensions of a tool joint provided with a lifting surface in accordance with the invention are such that the external diameter (OD1) of the first cylindrical portion is greater than or equal to the external diameter (OD3) of the second cylindrical portion, this external diameter (OD1) of the first cylindrical portion being less than the external diameter of the bearing zone (OD2). Such a configuration can be used to increase the surface envelope of the lifting surface without in any way modifying the critical technical and functional characteristics of the tube and of the second cylindrical portion in part defining the threaded portion of the tool joint. This enlargement of the envelope surface of the lifting surface can be used to compensate for the absence of contact surfaces with a lifting tool because of the activation zone.

In fact, it is not possible to index an element of the invention in rotation in a lifting tool, and in order to maintain the tensile capacities of the tool, the Applicant has identified that it is necessary to provide a lifting surface that can compensate for lifting deficiencies in the activation zone or zones.

In particular, the lifting surface may be such that an axial projection along the axis of the cylindrical body of this lifting surface onto a plane orthogonal to said axis comprises a solid inner annular surface radially surrounded towards the exterior by an outer annular surface, said outer annular surface having a serrated external border, wherein the valleys of said serrated external border correspond to the activation zones.

The element of the invention may comprise a female tool joint provided with a lifting surface, wherein the inner annular surface is non-zero, in particular represents at least 5%, preferably at least 15% of the total projected lifting surface of said female tool joint.

The element of the invention may also comprise a male tool joint provided with a lifting surface, wherein the inner annular surface is in the range 0 to 15%, preferably in the range 0 to 5% of the total projected lifting surface of said male tool joint. In this configuration, the lifting surfaces respectively presented by the two tool joints do not have to be symmetrical with respect to each other.

The invention also provides a method for assembling tubular drill stem elements in accordance with the invention, wherein the tool joint comprising the lifting surface is provided with a female threading on its internal wall and is disposed in a lifting tool such that the element is suspended vertically for assembly thereof with another vertically held element.

BRIEF DESCRIPTION OF THE DRAWINGS

The present invention will be better understood from the following detailed description of some embodiments made by way of non-limiting example and illustrated in the accompanying drawings, in which.

DETAILED DESCRIPTION

Figure 1:
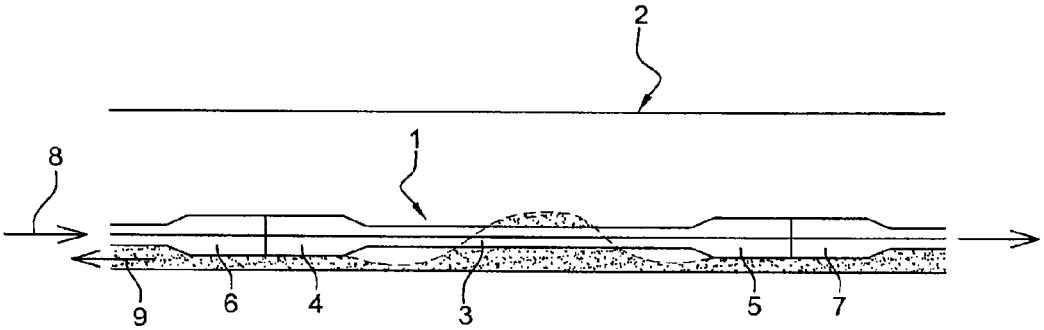
Fig. 1 Prior Art
FIG. 1 illustrates the operation of a conventional drill stem in a hole which is being formed.

FIG. 1 shows a portion of a drill stem 1 in a quasi-horizontal portion 2 of a well which is being formed. The drill stem 1 is represented in part by a hollow tubular element 3 comprising two tool joints 4 and 5, one at each end, connected via these tool joints to complementary tubular elements 6 and 7 of the stem. The stem 1 defines a continuous central space for the movement of a drilling fluid, as represented by the arrow 8. At the bottom of the hole, where the drilling tool such as a bit operates, the fluid or drilling mud then rises in an annular space defined between the wall of the drilled hole and the outer surface of the stem 1; see the arrow 9.

As it rises outside the drill pipe, the drilling fluid drives debris from the geological formations traversed by the drilling tool to the surface from which the well is being formed. The operation of a drill pipe of the prior art is represented in FIG. 1. FIG. 1 shows a zone where the debris conveyed by the drilling fluid has a tendency to accumulate. These accumulation zones form dunes and gradually, if they are not re-absorbed, can block the drilled well and block the drill pipe in the well. When the drill pipe is stuck in the well, it is very difficult to withdraw it from the well without creating large cracks in the walls of the drilled hole.

The drill pipe generally advances inside the well at a speed of about 10 feet per hour. At the same time, the drilling fluid has a higher rate of displacement than that of the pipe. More particularly, as the fluid rises, the speed of the drilling fluctuates along the column because of the variations in the external diameter of the drill pipe. In particular, at the tool joints such as 4 and 5, the fluid experiences an acceleration because the external diameter of the tool joints is larger than the external diameter of the drill pipe.

Figure 2:
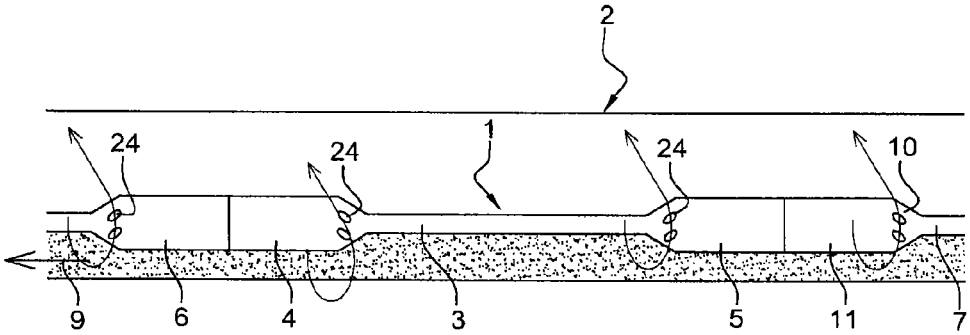
FIG. 2 illustrates the operation of a drill stem in accordance with the invention in the hole which is being formed.

In FIG. 2, where the numbering is retained for better understanding, it will be observed that a tool joint 11 of the adjacent element 7 comprises an activation zone 24 to promote the flow of drilling fluid at this interconnection. Advantageously, the tool joint 5 is itself also provided with one activation zone such as 24, and advantageously more, and the tool joint 4 is also provided with an activation zone such as 24. These activation zones promote the creation of a rising vortex current following the arrow 9. These vortex currents as well as the edges of the active grooves can scoop out debris from the accumulation zones and thus prevent the formation of these accumulation zones.

The two tool joints assembled together form said connection, for example, each comprising activation zones such as 24. The activation zones 24 of two tool joints which are connected together may be identical or different, and/or symmetrical with respect to a plane of symmetry or a point. In another variation, in the case in which each of the tool joints of the same element has activation zones such as 24, then they may be identical or symmetrical relative to a plane of symmetry transverse to the axis of the element, or with respect to a point, or they may be distinct.

The activation zones such as 24 of a hollow tubular element of the invention have a shape selected, for example, from those described as active grooves and/or channels in the documents EP-0 866 209; EP-1 026 364 or again U.S. Pat. No. 6,732,821.

Figure 3:
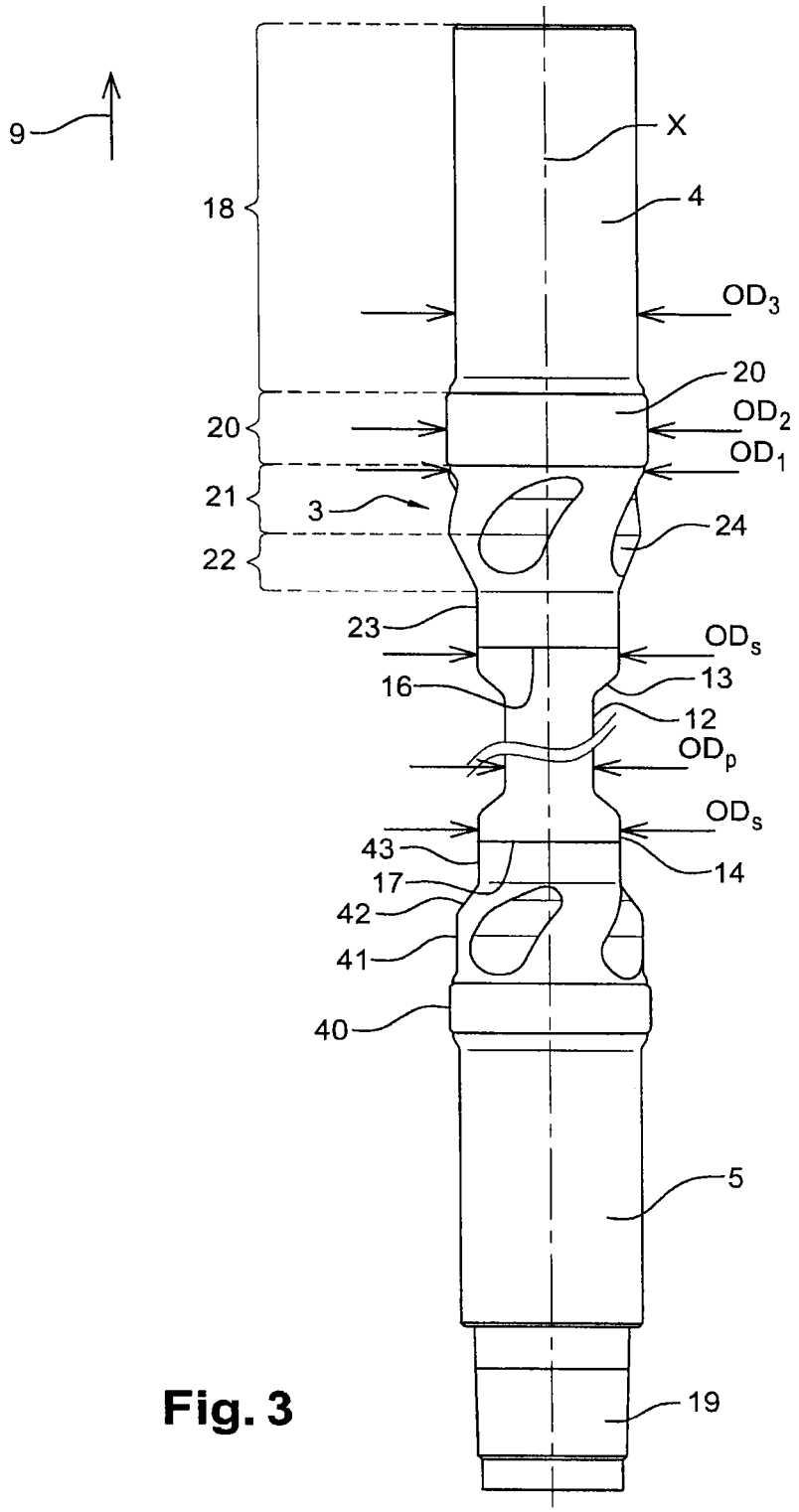
FIG. 3 shows a profile view of an element in accordance with the invention in a vertical position.

FIG. 3 represents a hollow tubular element 3 of the invention, with the central portion not shown. The general shape of this element 3 is a body of revolution about an axis X. The element 3 comprises an internal channel defined by an internal wall, this internal wall being a body of revolution about the X axis, for example. The element 3 may be produced from high strength steel.

The element 3 comprises a tubular body 12 with a principal extension along the X axis. The tubular body 12 is substantially cylindrical, and comprises two axially opposed ends 13 and 14, with an external diameter ODs which is greater than the external diameter ODp of the body 12 between these ends 13 and 14. Preferably, the body 12 has no axial weld and the internal bore is substantially constant.

In order to form the element 3, the ends 13 and 14 of the body 12 are friction welded to the respective tool joints 4 and 5. Thus, two weld zones 16 and 17 will be observed on the element 3 which have been heat-treated and are transverse to the X axis.

The tool joints 4 and 5 form relatively short profiled hollow tubular sections and form tool joints for connecting the elements together. The tool joints 4 and 5 may be female or male. In the example shown in FIG. 3, the tool joint 4 is female and the tool joint 5 is male. The female tool joint 4 comprises a female threaded connection portion 18 which constitutes a first free axial end of the element 3. The male tool joint 5 comprises a male threaded connection portion 19 which constitutes a second free axial end of the element 3.

The female threaded connection portion 18 comprises a bore provided with a female threading, not shown in FIG. 3. The female threading may be tapered, for example as defined in API specification 7 or in one of the Applicant's patents, for example U.S. Pat. No. 7,210,710, 6,513,840. Advantageously, the male threading 19 is complementary to the female threading.

Between the free end and the weld zone 16, the external perimeter of the female tool joint 4 comprises, in succession along the X axis, the external cylindrical perimeter of the female threaded connection portion 18, a bearing zone 20, which comes to bear on the internal walls of a well being formed, a first cylindrical portion 21, a lifting surface 22 and a connecting zone 23 having an external cylindrical surface up to its end welded by the weld zone 16. The connecting zone 23 is a cylindrical portion with an external diameter of the order of the external diameter ODs of the axial end 13.

The female threaded connection portion 18 has an external perimeter forming a second cylindrical portion opposite to the first cylindrical portion 21 relative to the bearing zone 20.

Figure 4:
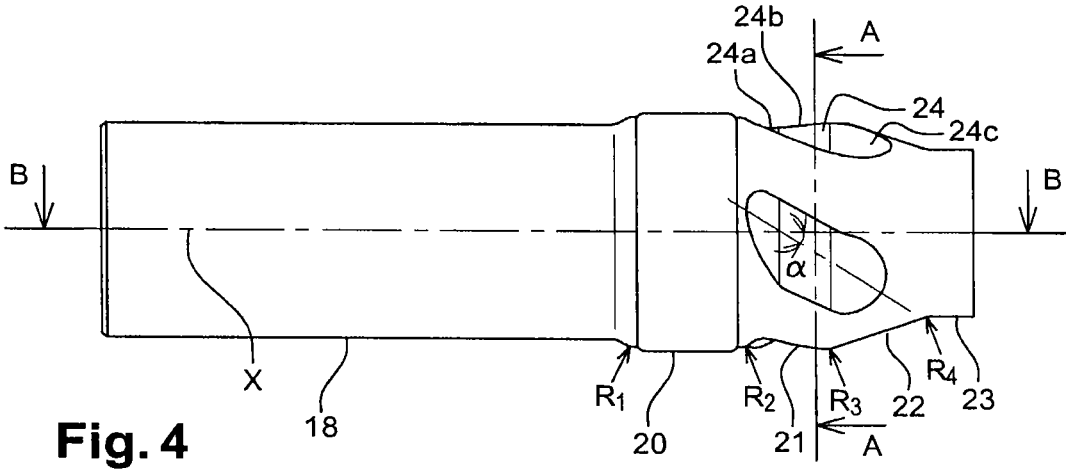
FIG. 4 shows a profile view of a female tool joint of an element of the invention before it is connected to a body.

In FIG. 4, the second cylindrical portion 18 is connected to the bearing zone 20 via a first curved transition R1. The bearing zone 20 is connected to the first cylindrical portion 21 via a second curved transition R2. The first cylindrical portion 21 is connected to the lifting surface 22 via a third curved transition R3. The lifting surface 22 is connected to the connecting zone 23 via a fourth curved transition R4. These curved transitions R1, R2, R3, R4 may be simple toroidal transitions or they may be complex, with varying radii of curvature and/or inflections along the X axis.

In the example shown in FIG. 4, the curved transition R4 is a toroidal surface. The curved transition R3 varies circumferentially in that it is discontinuous and defined only level with the junctions with the lifting surface 22 in positions of this lifting surface 22 which are free of concave activation zones. The curved transition R3 is a toroidal surface.

The lifting surface 22 is the surface against which the weight of the element 3 will be exerted when it is held vertically by a lifting tool. In FIG. 3, the element 3 is shown vertically in its direction of insertion into a lifting tool, the female tool joint being disposed at the top. The lifting tool is, for example, an elevator on the rig.

The lifting surface 22 comprises an external diameter which generally increases from the connecting zone 23 to the first cylindrical portion, which corresponds to an increasing diameter in the direction of flow of drilling mud in accordance with the arrow 9.

In the example shown, the envelope surface of the lifting surface 22 is tapered, forming an angle of 18° with the longitudinal X axis.

The lifting surface 22 and the first cylindrical portion 21 comprise active grooves or activation zones 24 extending respectively in the lifting surface and the cylindrical portion.

Figure 5:
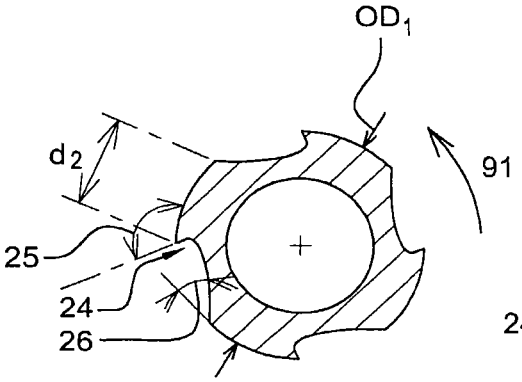
FIG. 5 shows a cross-sectional view of a female tool joint of an element of the invention in the sectional plane A-A indicated in FIG. 4.

In the embodiment of FIGS. 3 and 4, the female tool joint 4 comprises four activation zones such as 24 forming distinct concavities on its circumference. As can be seen in FIG. 5, these four concavities 24 are distributed radially equally over respectively the lifting surface 22 and the first cylindrical portion 21.

Figure 6:
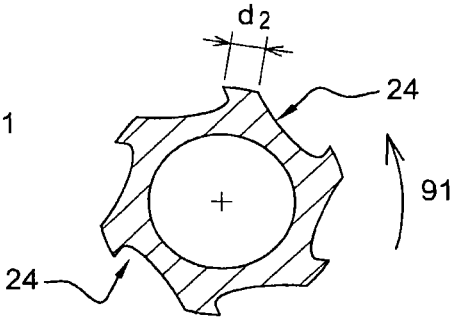
FIG. 6 shows a variation of the embodiment of the invention of FIG. 5.

In a variation, shown in FIG. 6, the female tool joint 4 comprises six concavities 24 distributed radially equally.

As illustrated in FIGS. 5 and 6, the activation zones 24 have a bi-symmetrical profile in the form of a scoop with an obtuse angle 25 with respect to an external circular portion of the section of the lifting surface 22 on one side and an acute angle 26 on the opposite side. The acute angle 26 is, for example, in the range 50° to 80°, preferably in the range 60° to 70°, for example 65°. The acute angle 26 may be provided on the back side in the direction of rotation 91 of the drill stem. It will be recalled here that a drill pipe string is always driven in rotation in the same sense in order to prevent breakout of the threaded connections 4 and 5. The obtuse angle 25 provided on the front or entry side is designed to facilitate entry of trickles of fluid. The obtuse angle 25 is, for example, in the range 100° to 130°, preferably in the range 110° to 120°, for example 115°. This bi-symmetrical profile ensures a debris scooping function.

The minimum distance $d_2$ of the arc of a circle between adjacent two active grooves 24 may be in the range 10 to 50 mm, preferably in the range 20 to 40 mm, for example 30 mm.

An activation zone 24 has a maximum depth relative to the circular perimeter which is of the order of 5 to 30 mm, preferably 10 to 25 mm.

In FIG. 4, the activation zones 24 form portions of a spiral with an inclination a in the range 15° to 35° with respect to the X axis. Alternatively, in an embodiment which is not shown, the activation zones 24 may be rectilinear, or even rectilinear and parallel to the X axis.

Figure 7:
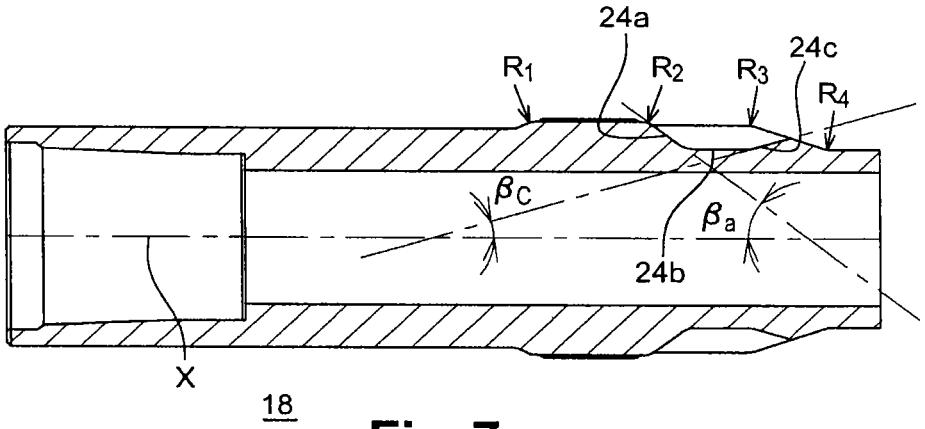
FIG. 7 shows a longitudinal sectional view of a female tool joint of an element of the invention in the sectional plane B-B indicated in FIG. 4.
Figure 8:
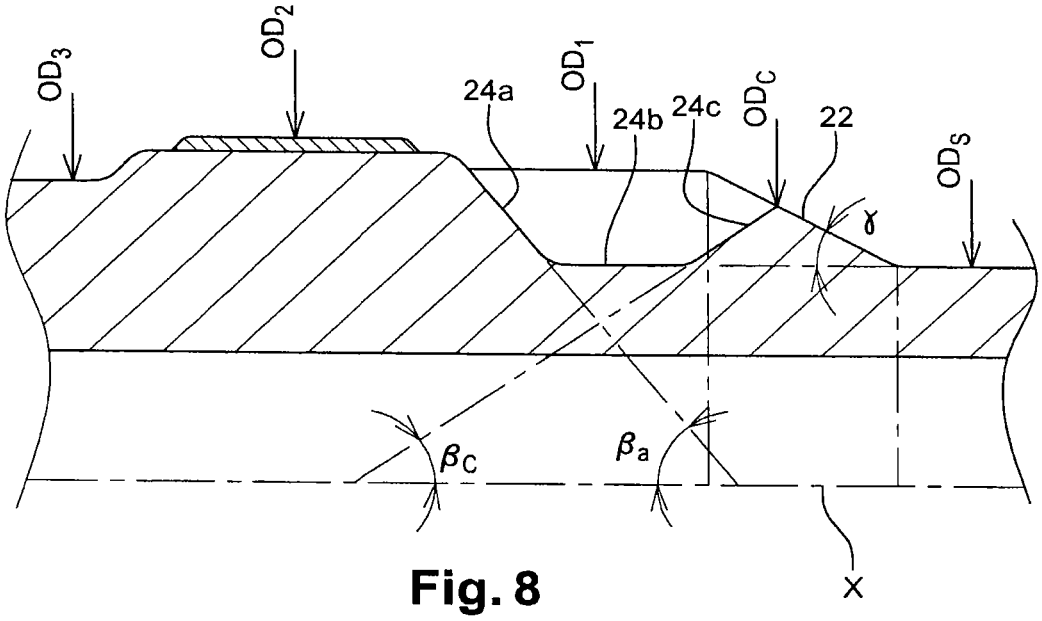
FIG. 8 shows an enlargement of a zone indicated in FIG. 7.

In particular, in the detail in FIGS. 7 and 8, the activation zone 24 of the female tool joint can be broken down into a first portion 24*a* forming a hollow the bottom of which is inclined by an acute angle βa in the range 30° to 60°, preferably in the range 40° to 50°, for example 45° with respect to the X axis. This first portion 24*a* extends into a central second portion 24*b* the bottom of which is substantially parallel to the X axis. This central second portion 24*b* extends into a third portion 24*c* the bottom of which is inclined by an acute angle βc in the range 10° to 30°, preferably in the range 15° to 25°, for example 20°, with respect to the X axis.

The axial length of the central second portion 24*b* may be in the range 20 to 60 mm, more preferably in the range 30 to 40 mm, for example 36 mm. The axial length of the third portion 24*c* may be in the range 10 to 50 mm, preferably in the range 20 to 30 mm.

The bearing zone 20 in FIGS. 7 and 8 comprises a coating or resurfacing formed from a material which is harder than the rest of the element 3. The hard material may include tungsten carbide or chromium carbide. The hard material may have a thickness in the range 1 to 10 mm, for example 2 to 4 mm. Said hard material is in the form of a hard coating which may be attached by a welding operation or by thermal spraying (for example by means of a flame or plasma). The bearing zone 20 is provided to withstand axial and rotational friction against the wall of the drilled hole.

Figure 9:
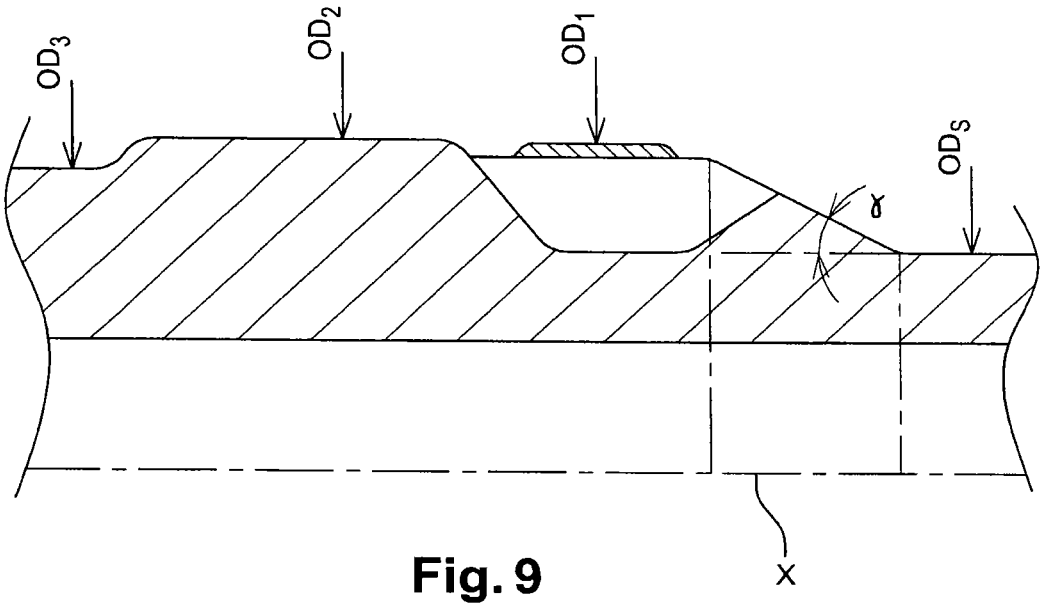
FIG. 9 shows a variation of the embodiment of the invention of FIG. 8.
Figure 13:
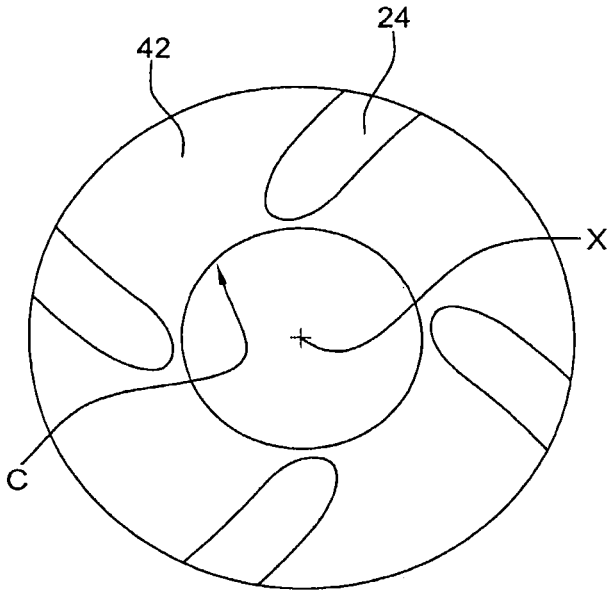
FIG. 13 shows an axial projection of a lifting surface of a male tool joint of the invention, the projection being made along the axis of the cylindrical body onto a plane orthogonal to said axis.
Figure 11:
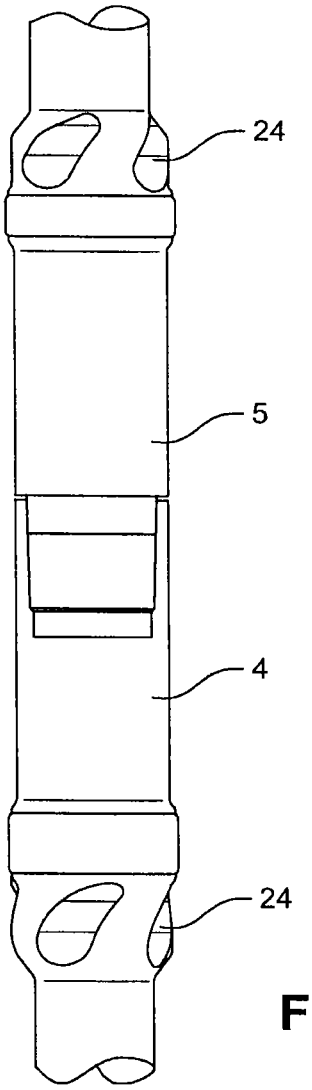
FIG. 11 shows a profile view of a junction between two tool joints of two elements of the invention.

In a variation shown in FIG. 9, the resurfacing is deposited on the cylindrical portion 21 outside the activation zones 24. In this case, the resurfacing is deposited after machining the activation zones 24.

In FIGS. 8 and 9, the first cylindrical portion has a maximum external diameter OD1, in particular determined outside the activation zones 24, which is determined relative to the external diameter ODs of the connecting zone 23 such that the lifting surface 22 has an inclination y of the order of 18° with respect to the X axis.

In particular, in FIGS. 8 and 9, the maximum external diameter OD1 is greater than the external diameter OD3 of the second cylindrical portion 21. In particular, OD1 is in the range 1.05 to 1.5 times the external diameter OD3. The maximum external diameter OD1 is also less than or equal to the external diameter OD2 of the bearing surface 20. In fact, when the maximum external diameter OD1 is equal to the external diameter OD2, the advantage of depositing the resurfacing on the first cylindrical portion 21 is increased to protect it. This configuration can also limit the maximum total diameter of the element of the invention.

The lifting surface 22 defines a tapered envelope surface provided with a concavity, in particular the third portions 24*c* of the activation zones 24. The bearing surface proposed for the lifting is thus less than its envelope surface. In order to understand the proportion of this envelope surface covering the activation zones 24, FIG. 10 shows a projection of this envelope surface onto a plane orthogonal to the X axis.

Figure 10:
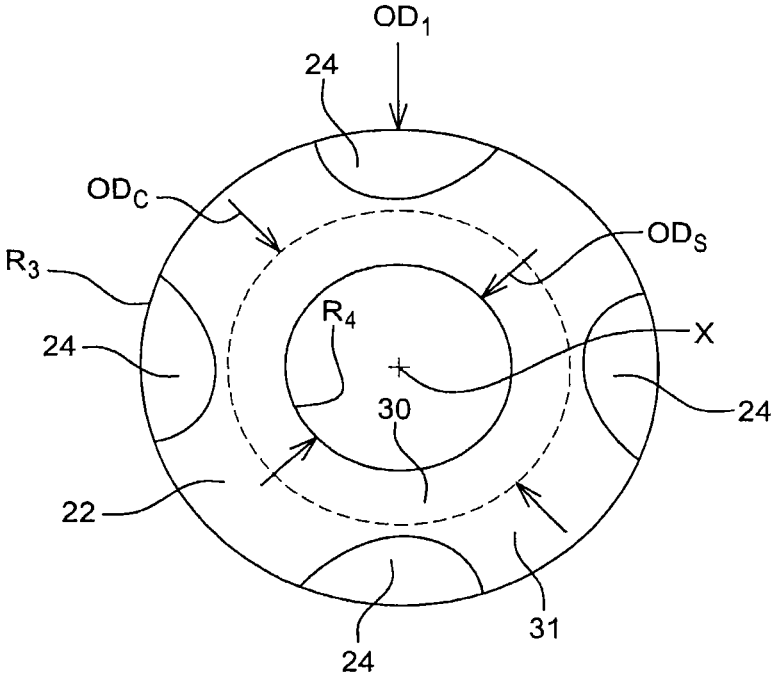
FIG. 10 shows an axial projection of a lifting surface of a female tool joint of the invention, the projection being made in the axis of the cylindrical body onto a plane orthogonal to said axis.

FIG. 10 shows an axial projection along the X axis of this lifting surface 22 onto a plane orthogonal to said X axis. The axial projection defines a ring. This ring comprises an inner annular surface 30. The inner annular surface 30, adjacent to the curved portion R4, is solid and does not have any activation zones 24. The inner annular surface 30 is radially surrounded towards the outside by a second annular surface 31. This second annular portion 31 comprises the activation grooves 24.

The boundary between the inner annular surface 30 and the outer annular surface 31 is defined by a circle C shown as a dashed line in FIG. 10; the perimeter is defined so as to come into tangential contact with at least one activation zone. The circle C has a diameter ODc which is greater than or equal to the diameter ODs of the connecting zone 23. This diameter ODc is strictly smaller than the diameter OD1. The diameter ODc is, for example, in the range 1.05 to 1.15 times the diameter ODs.

In particular, the first annular surface 30 is non-zero. It is equal to $3.14\times[(ODc)^2-(ODs)^2]$. It represents at least 5%, preferably at least 15% of the total projected lifting surface of said female tool joint. This total projected surface is equal to $3.14\times[(OD1)^2-(ODs)^2]$.

The diameter OD1 is determined so as to propose a bearing surface for the lifting surface 22 which can be used to compensate for bearing deficiencies level with the activation zones 24.

The second annular portion 31 has an external serrated border wherein the valleys of this external serrated border correspond to the activation zones 24. Between the activation zones 24, this external serrated border has a curved portion R3.

In FIG. 3, the element 3 of the invention comprises a male tool joint 5. In a manner similar to the female tool joint, the male tool joint may have activation zones such as 24 forming concavities in a tapered portion. In particular, the activation zones of the male tool joint are partly formed in the tapered lifting surface 42, which could act as a lifting surface in a lifting tool. Between the weld zone 17 and the free end of the threaded portion 19, the external perimeter of the male tool joint 5 comprises, in succession along the X axis, a connecting zone 43, a tapered lifting surface 42, a third cylindrical portion 41, a bearing zone 40, and a fourth cylindrical portion 49 up to the threaded portion 19. The connecting zone 43 is a cylindrical portion with an external diameter of the order of the external diameter ODs.

In contrast to the lifting surface 22 of the female tool joint, the tapered lifting surface 42 of the male tool joint is such that the activation grooves extend until they are almost flush with the curved portion defining the tapered lifting surface 42 of the connecting zone 43.

Figure 12:
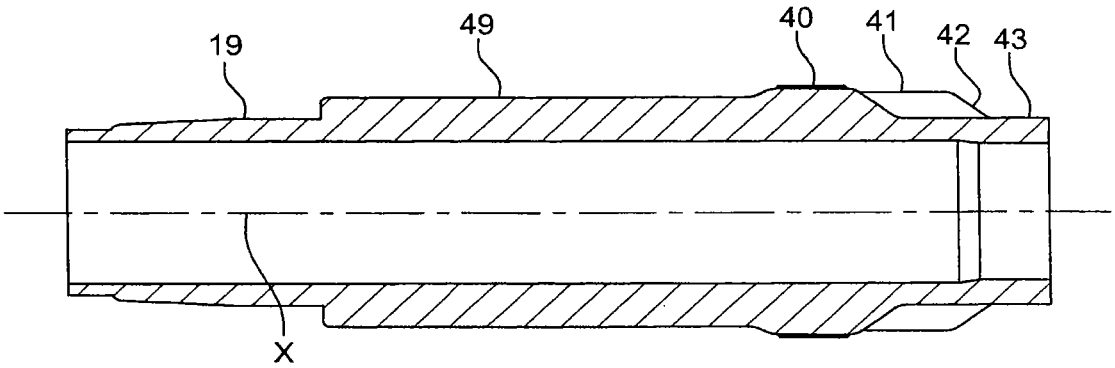
FIG. 12 shows a longitudinal sectional view of a male tool joint of an element of the invention.

In a manner similar to FIG. 10, FIG. 12 shows a similar view of the lifting surface 42. The inner annular surface is much smaller than that of the lifting surface 22. The surface of the activation zones such as 24 occupy a much larger proportion of the male lifting surface 42 than that occupied by the activation zones on the female lifting surface 22.

The bearing zone 40 may have geometrical, physical and/or chemical characteristics similar to those of the bearing zone 20.

Optionally, the tool joints 4 and 5 may comprise grooves, not shown, at the surface of the second cylindrical portion of the female connection portion 18, close to the bearing zone 20. These grooves can thus equally allow the recirculation of mud and debris during drilling and scrape the walls of the hole when lifting the pipe string.

The invention claimed is:

1. A tubular element for a drill stem assembly and for receiving a lifting tool, the tubular element comprising:

a substantially cylindrical body and two tool joints, each tool joint being disposed at one end of the body and provided with a threaded portion which can be joined to a complementary element, at least one of the tool joints having a bearing zone that has a widest diameter of the at least one of the tool joints and is configured to bear on the internal walls of a well being formed and a lifting surface, the lifting surface being tapered and positioned between the bearing zone and the body, drilling fluid concavities intersecting the tapered lifting surface to form a non-circular cross-section of the tapered lifting surface, the drilling fluid concavities and the non-circular cross-section of the tapered lifting surface forming an activation zone for a drilling fluid, and wherein the non-circular cross-section that forms the activation zone of the lifting surface of the tubular element is configured to contact and receive the lifting tool to connect the tubular element to the drill stem assembly.

2. The assembly according to claim 1, wherein the non-circular cross-section further comprises a flat surface.

3. The assembly according to claim 2, wherein at least one of the drilling fluid concavities forms a groove extending beyond the lifting surface in the direction of a free end of said at least one of the tool joints.

4. The assembly according to claim 2, wherein the drilling fluid concavities comprise several distinct concavities in a circumferential direction.

5. The assembly according to claim 1, wherein the activation zone has a generally helical shape about the axis of said element, such that the inclination of the helical shape relative to the longitudinal axis is in the range 0° to 60°.

6. The assembly according to claim 5, wherein the inclination of the helical shape relative to the longitudinal axis is in the range 10° to 30°.

7. The assembly according to claim 1, wherein the activation zone of the at least one of the tool joints is disposed in a unique annular section of said at least one of the tool joints.

8. The assembly according to claim 1, wherein the lifting surface is connected to the bearing zone via a first cylindrical portion, the bearing zone being connected to a second cylindrical portion in the direction of a free end of the at least one of the tool joints.

9. The assembly according to claim 8, wherein the activation zone extends into the first cylindrical portion.

10. The assembly according to claim 8, wherein at least one of the bearing zone and the first cylindrical portion comprises a hardened surface.

11. The assembly according to claim 10, wherein the hardened surface is a material with a greater hardness than that of the at least one of the tool joints.

12. The assembly according to claim 8, wherein an external diameter of the first cylindrical portion is greater than or equal to an external diameter of the second cylindrical portion, the external diameter of the first cylindrical portion being less than an external diameter of the bearing zone.

13. The assembly according to claim 1, wherein the lifting surface is such that an axial projection along the axis of the cylindrical body of this lifting surface onto a plane orthogonal to said axis comprises a solid inner annular surface radially surrounded towards the exterior by a second annular surface having a serrated external border, and wherein the valleys of said serrated external border correspond to the activation zones.

14. The assembly according to claim 13, wherein the at least one of the tool joints that is provided with the lifting surface is a female tool joint, and wherein the first annular surface is a non-zero amount of the lifting surface of said female tool joint.

15. The assembly according to claim 14, wherein the non-zero amount is at least 5% of the total projected lifting surface of said female tool joint.

16. The assembly according to claim 13, wherein the at least one of the tool joints that is provided with the lifting surface is a male tool joint, wherein the first annular surface is in the range 0 to 15% of the lifting surface of said male tool joint.

17. A method for assembling tubular drill stem elements, comprising:

providing a plurality of the tubular drill stem elements, each tubular drill stem element comprising a substantially cylindrical body and two tool joints, each tool joint being disposed at one end of the body and provided with a threaded portion which can be joined to a complementary element, at least one of the tool joints having a bearing zone that has a widest diameter of the at least one of the tool joints and is configured to bear on the internal walls of a well being formed and a lifting surface, the lifting surface being tapered and positioned between the bearing zone and the body, the tool joint that includes the tapered lifting surface also includes a female threading on its internal wall, and drilling fluid concavities intersecting the tapered lifting surface to form a non-circular cross-section of the tapered lifting surface, the drilling fluid concavities and the non-circular cross-section of the tapered lifting surface forming an activation zone for a drilling fluid; and suspending the tubular drill stem element at the non-circular cross-section that forms the activation zone of the lifting surface of the tubular drill stem element such that the tubular drill stem element is suspended vertically for assembly thereof with another vertically held element.

18. A tubular element for a drill stem assembly and for receiving a lifting tool, the tubular element comprising:

at least one tubular element comprising:

a substantially cylindrical body and two tool joints, each tool joint being disposed at one end of the body and provided with a threaded portion which can be joined to a complementary tool joint, at least one of the tool joints having a bearing zone that has a widest diameter of the at least one of the tool joints and is configured to bear on the internal walls of a well being formed;

a tapered lifting surface positioned between the bearing zone and the body, the tapered lifting surface having an external diameter that increases in diameter in the direction of the bearing zone; and drilling fluid grooves in the tapered lifting surface that form a drilling fluid activation zone to recirculate a drilling fluid;

wherein the tapered lifting surface is configured to contact the lifting tool at the activation zone over the drilling fluid grooves.

* * * * *